United States Patent [19]

Baeck et al.

[11] Patent Number: 5,019,292

[45] Date of Patent: May 28, 1991

[54] DETERGENT COMPOSITIONS

[75] Inventors: André C. Baeck, Bonheiden, Belgium; Young S. Oh, Fairfield, Ohio

[73] Assignee: The Procter & Gamble Company, Cincinnati, Ohio

[21] Appl. No.: 287,978

[22] Filed: Dec. 21, 1988

Related U.S. Application Data

[63] Continuation-in-part of Ser. No. 68,281, Jun. 30, 1987, abandoned.

[30] Foreign Application Priority Data

Jun. 28, 1988 [EP] European Pat. Off. ..... 88201330.3

[51] Int. Cl.[5] ..... C11D 3/12; C11D 1/75

[52] U.S. Cl. ..... 252/174.25; 252/8.6; 252/8.8; 252/135; 252/544; 252/546; 252/547

[58] Field of Search ..... 252/135, 544, 546, 547, 252/8.6, 8.8, 174.25

[56] References Cited

U.S. PATENT DOCUMENTS

| | | | |
|---|---|---|---|
| 2,920,045 | 1/1960 | Hearn et al. | 252/137 |
| 3,033,699 | 5/1962 | Aarons et al. | 106/286 |
| 3,594,221 | 7/1971 | Baldwin | 117/138.5 |
| 3,915,882 | 10/1975 | Nirschl et al. | 252/131 |
| 3,959,155 | 5/1976 | Montgomery et al. | 252/8.8 |
| 3,989,631 | 11/1976 | Marsan | 252/8.6 |
| 4,062,647 | 12/1977 | Storm et al. | 8/137 |
| 4,178,254 | 12/1979 | Leikhim et al. | 252/8.6 |
| 4,199,464 | 4/1980 | Cambre | 252/91 |
| 4,292,035 | 9/1981 | Battrell | 8/137 |
| 4,294,710 | 10/1981 | Hardy et al. | 252/8.8 |
| 4,597,886 | 7/1986 | Goedhardt et al. | 252/95 |
| 4,609,473 | 9/1986 | Ramachandran et al. | 252/8.6 |
| 4,689,167 | 8/1987 | Collins et al. | 252/95 |
| 4,770,815 | 9/1988 | Bakker et al. | 252/542 |

FOREIGN PATENT DOCUMENTS

| | | |
|---|---|---|
| 0088372 | 9/1983 | European Pat. Off. . |
| 0133804 | 3/1985 | European Pat. Off. . |
| 0168889 | 9/1985 | European Pat. Off. . |
| 1400898 | 7/1975 | United Kingdom . |

OTHER PUBLICATIONS

"Veegum the Super Natural Ingredient", Sales pamphlet, R. T. Vanderbilt Company Booklet No. 97, Sep. 1987.

Rengasamy et al., *Particle Size Wyoming Bentonite . . .*, J. Chem. Soc. Faraday Trans. I.; 72(2), 376–381; 1976.

Schott, *Uptake of Clay by Cotton,* Textile Research Journal, pp. 610–620, Jul. 1965.

*Primary Examiner*—Josephine Barr
*Assistant Examiner*—Alexander G. Ghyka
*Attorney, Agent, or Firm*—Leonard W. Lewis; Jerry J. Yetter; Richard C. Witte

[57] ABSTRACT

Detergent compositions are disclosed which comprise, as a fabric softening ingredient, a fabric softening clay. The fabric softening clay is a hectorite of natural origin, having a layer change distribution such that at least 50% is in the range 0.23–0.31. The clays preferably exhibit Relative Deposition values of at least 2.5.

13 Claims, No Drawings

DETERGENT COMPOSITIONS

This application is a continuation-in-part application of U.S. Ser. No. 068,281, filed June 30, 1987, now abandoned.

The present invention relates to granular detergent compositions. More specifically it relates to detergent compositions containing a fabric-softening amount of a hectorite clay, the clay being in the form of particles having a narrowly-defined layer charge distribution and preferably having a high level of deposition upon fabrics.

British Patent No. 1 400 898 discloses detergent compositions comprising, as a fabric-softening ingredient, a smectite-type clay. Any smectite-type clay having a cation exchange capacity of at least 50 meq/100 g is taught to be suitable. Gelwhite GP and Volclay BC, both of which are sodium montmorillonite clays, are disclosed to be preferred for reasons of color and cation exchange capacity.

It is now well recognized in the detergent industry that clays of the type disclosed in British Patent No. 1 400 898 provide significant fabric softening benefits when used in a laundry detergent. Yet, it is equally well recognized that deposition of these clays onto the fabrics during the laundering process is far from complete; in fact, under typical European laundry conditions, less than half of the available clay is deposited onto the fabrics, the remainder being rinsed away with the laundry liquor during the subsequent rinsing steps. Moreover, the softening effect obtained as a result of the clay deposition is affected by factors that are not well understood.

It is, therefore, an object of the present invention to provide detergent compositions comprising a fabric-softening clay from which the clay particles are more efficiently desposited onto fabrics during the laundry process. It is another object of the present invention to provide detergent compositions from which clay particles are efficiently deposited, regardless of the builder system used. It is a further object of this invention to select clay materials for use in detergent compositions that provide a significantly better fabric-softening performance than the clay materials used to date in commercial softeness-through-the-wash detergent compositions.

SUMMARY OF THE INVENTION

The present invention relates to granular detergent compositions containing at least about 1% of a detersive surfactant, from about 5% to about 35% detergent builders and from about 1% to about 25% of a hectorite clay of natural origin. The clay is in the form of particles. The particles have a narrowly defined layer charge distribution, such that at least about 50% of the clay has a layer charge of from about 0.23 to about 0.31. Preferably the compositions of the present invention exhibit relative depositions of at least about 2.5.

DETAILED DESCRIPTION OF THE INVENTION

The granular detergent compositions of the present invention comprise conventional detersive surfactants, conventional detergent builders and, optionally, other conventional detergent ingredients. The compositions further comprise a fabric-softening amount, typically from 1% to 25% by weight of the detergent composition, of a fabric-softening clay as described below. The clay, which is of the smectite-type, is selected on basis of its layer charge properties. The hectorite clays of natural origin, suitable for the detergent compositions of the present invention, have the general formula:

$$[Mg_{3-x}Li_x)\ Si_{4-y}Me_yO_{10}(OH_{2-z}F_z)]^{-(x+y)}\ \frac{(x+y)}{n}\ M^{n+}$$

wherein y=o; or, if y=o, $Me^{III}$ is Al, Fe, or B: $M^{n+}$ is a monovalent (n=1) or divalent (n=2) metal ion, for example selected from Na, K, Mg, Ca, Sr. The value of (x+y) is the layer charge of the hectorite clay. The hectorite clays suitable for the detergent compositions of the present invention have a layer charge distribution such that at least 50% is in the range of from 0.23 to 0.31.

Preferred are hectorite clays of natural origin having a layer charge distribution such that at least 65% is in the range of from 0.23 to 0.31.

The layer charge distribution of the clay material can be determined using its swelling in the presence of cationic surfactants having specific chain lengths. This method is described in detail by Lagaly and Weiss, Zeitschrift fuer Pflanzenernaehrung und Bodenkunde, 130(1), 1971, pages 9–24, the disclosures of which are incorporated herein by reference.

Recently, a method has developed for objective assessment of fabric softeners. The method consists of a battery of tests, known in the detergent industry as the KES-F system of Kawabata. The method is described in S. Kawabata, "The Standardization and Analysis of Hand Evaluation", 2nd Ed., Textile Mach. Soc. of Japan, Osaka, 1980, the disclosures of which are incorporated herein by reference.

It has been found that one of the parameters, of the KES-F system, the shear hysteresis parameter 2HG5, is particularly useful in the characterization of fabric softening clays. Preferred herein are hectorite clays which, when incorporated in detergent compositions at 10% by weight, reduce the shear hysteresis of fabrics laundered therein by at least 32%, more preferable by at least 35%. The shear hysteresis parameter 2HG5 is discussed in more detail in Finnimore and Koenig, Melliand Textilberichte 67 (1986) pages 514–516, the disclosures of which are incorporated herein by reference.

Shear hysteresis is determined on cotton terry towels, with detergent compositions containing 10% (weight) of the clay to be tested. The test is described more fully in the Examples hereinbelow.

The preferred hectorite clays used in the detergent compositions can be further characterized by their high level of deposition onto fabrics. Deposition of hectorite clays of the present invention from a detergent composition onto fabrics is surprisingly greater than the deposition of other naturally occurring clays. Deposition can be measured according to the Relative Deposition procedure described in Examples XII–XV. The Relative Deposition of the clays of the present invention is preferably at least about 2.5 more preferably at least about 2.7, and most preferably at least about 2.9. The Relative Deposition of these clays appears to be proportional to the softness of the treated fabric. Examples of suitable hectorite clays include Bentone EW and Macaloid, both mined in or near Amargosa Valley, Nev. (U.S.A.) and available from NL Chemicals, N.J. Naturally occurring hectorite clays within the scope of the present invention also include IMV Hectorite, available from Industrial Mineral Ventures, Amargosa Valley, Nev. Also encompassed herein are hectorites mined in Turkey such as, but not limited to, Turkish calcium hectorite clay.

OTHER DETERGENT COMPONENTS

Detersive Surfactants—The composition of this invention will typically contain organic surface-active agents ("surfactants") to provide the usual cleaning benefits associated with the use of such materials.

Detersive surfactants useful herein include well-known synthetic anionic, nonionic, amphoteric and zwitterionic surfactants. Typical of these are the alkyl benzene sulfonates, alkyl- and alkylether sulfates, paraffin sulfonates, olefin sulfonates, alkoxylated (especially ethoxylated) alcohols and alky phenols, amine oxides, alpha-sulfonates of fatty acids and of fatty acid esters, and the like, which are well-known from the detergency art. In general, such detersive surfactants contain an alkyl group in the $C_9$–$C_{18}$ range. The anionic detersive surfactants can be used in the form of their sodium, potassium or triethanolammonium salts; the nonionics generally contain from about 5 to about 17 ethylene oxide groups. U.S. Pat. No. 3,955,669, the disclosures of which are incorporated herein by reference, contains detailed listings of such typical detersive surfactants. $C_{11}$–$C_{16}$ alkyl benzene sulfonates, $C_{12}$–$C_{18}$ paraffin sulfonates and alkyl sulfates, and the ethoxylated alcohols and alkyl phenols are especially preferred in the compositions of the present type.

Also useful herein as the surfactant are the water-soluble soaps, e.g. the common sodium and potassium coconut or tallow soaps well-known in the art.

The surfactant component can comprise as little as 1% of the compositions herein, but preferably the compositions will contain 5% to 40%, preferably 10% to 30%, of surfactant. Mixtures of the ethoxylated nonionics with anionics such as the alkyl benzene sulfonates, alkyl sulfates and paraffin sulfonates are preferred for through-the-wash cleansing of a broad spectrum of soils and stains from fabrics. However, excessively high levels of nonionic surfactant negatively affect the deposition of softening clays. Compositions containing 4% or less nonionic surfactant are therefore preferred.

Detersive Adjuncts—The composition herein can contain other ingredients which aid in their cleaning performance. For example, it is highly preferred that through-the-wash detergent compositions contain a detergent builder and/or metal ion sequestrant. Compounds classifiable and well-known in the art as detergent builders include the nitrilotriacetates, polycarboxylates, citrates, carbonates, zeolites, water-soluble phosphates such as tri-polyphosphate and sodium ortho- and pyro-phosphates, silicates, and mixtures thereof. Metal ion sequestrants include all of the above, plus materials like ethylenediaminetetraacetate, the aminopolyphosphonates (DEQUEST) and a wide variety of other poly-functional organic acids and salts too numerous to mention in detail here. See U.S. Pat. No. 3,579,454 for typical examples of the use of such materials in various cleaning compositions. In general, the builder/sequestrant will comprise about 0.5% to 45% of the composition. The 1–10 micron size zeolite (e.g. zeolite A) builders disclosed in German patent No. 2 422 655 are especially preferred for use in low-phosphate compositions.

Particularly suitable phosphate-free builders are ether carboxylate mixtures comprising (a) from 1% to 99% of a tartrate monosuccinate component of the structure

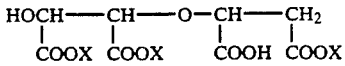

wherein X is H or salt-forming cation; and (b) from 1% to 99% by weight of a tartrate disuccinate component of the structure:

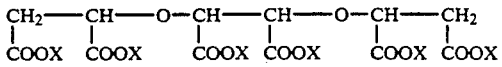

wherein X is H or a salt-forming cation.

Builder systems of this type are more fully disclosed in U.S. Pat. No. 4,663,071, issued May 5, 1987 to Busch et al, the disclosures of which are incorporated herein by reference.

Typical detergent compositions contain from 5% to 35% of this builder.

The laundry compositions herein also preferably contain enzymes to enhance their through-the-wash cleaning performance on a variety of soils and stains. Amylase and protease enzymes suitable for use in detergents are well-known in the art and in commercially available liquid and granular detergents. Commercial detersive enzymes (preferably a mixture of amylase and protease) are typically used at levels of 0.001% to 2%, and higher, in the present compositions. Detergent cellulase enzymes provide both cleaning and softening benefits, particularly to cotton fabrics. These enzymes are highly desirable in the detergent compositions of this invention.

The compositions herein can contain other ingredients which aid in their cleaning performance. For example, the compositions herein can advantageously contain a bleaching agent, especially a peroxyacid bleaching agent. In the context of the present invention, the term peroxyacid bleaching agent encompasses both peroxyacids per se and systems which are able to yield peroxyacids in situ.

Peroxyacids per se are meant to include the alkaline and alkaline-earth metal salts thereof. Peroxyacids and diperoxyacids are commonly used; examples are diperoxydodecanoic acid (DPDA) or peroxyphthalic acid.

Systems capable of delivering peracids in situ consist of a peroxygen bleaching agent and an activator thereof.

The peroxygen bleaching agents are those capable of yielding hydrogen peroxide in an aqueous solution; these compounds are well-known in the art, and include hydrogen peroxide, alkali-metal peroxides, organic peroxide bleaching agents such as urea peroxide, inorganic persalt bleaching agents such as alkali metal perborates, percarbonates, perphosphates, persilicates, and the like.

Preferred are sodium perborate, commercially available in the form of mono- and tetra-hydrates, sodium carbonate peroxyhydrate, sodium pyrophosphate peroxyhydrate and urea peroxyhydrate.

The liberated hydrogen peroxide reacts with a bleach activator to form the peroxyacid bleach. Classes of bleach activators include esters, imides, imidazoles, oximes, and carbonates. In these classes, preferred materials include methyl o-acetoxy benzoates; sodium-p-acetoxy benzene sulfonates such as sodium 4-nonanoxyloxybenzene sulfonate; sodium-4-octanoyloxybenzene sulfonate, and sodium-4-decanoyloxybenzenesulfonate: biophenol A diacetate; tetra acetyl ethylene diamine; tetra acetyl hexamethylene diamine; tetra acetyl methylene diamine.

Other highly preferred peroxygen bleach activators which are disclosed in U.S. Pat. Nos. 4,483,778 and 4,539,130, the disclosures of which are incorporated herein by reference, are alpha-substituted alkyl or alkenyl esters, such as sodium-4-(2-chloroctanoyloxy)benzene sulfonate, sodium 4-(3,5,5-trimethyl hexanoyloxy)-benzene sulfonate. Suitable peroxyacids are also peroxygen bleach activators such as described in published European Patent Application No. 0 116 571, i.e., compounds of the general type RXAOOH and RXAL, wherein R is a hydroxcarbyl group, X is a hetero-atom, A is a carbonyl bridging group and L is a leaving group, especially oxybenzenesulfonate.

Other highly desirable detergent ingredients for use in the detergent compositions of the present invention are quaternary ammonium compounds of the formula $R_4R_5R_6R_7N^+X^-$, wherein $R_4$ is alkyl having from about 8 to 20, preferably from 12–18 carbon atoms, $R_5$ is alkyl having from 1 to 10 carbon atoms, and $R_6$ and $R_7$ are each $C_1$ to $C_4$ alkyl preferably methyl: $X^-$ is an anion, e.g. chloride. Examples of such quaternary ammonium compounds include $C_{12}$–$C_{14}$ alkyl trimethyl ammonium chloride and cocoalkyl trimethyl ammonium methosulfate. The quaternary ammonium compounds can be used at levels from 0.5% to 5%.

ADDITIONAL SOFTENING INGREDIENTS

The detergent compositions of the present invention may further contain, in addition to the clay material, other softening ingredients. Suitable examples include amines of the formula $R_1R_2R_3N$, wherein $R_1$ is $C_6$ to $C_{20}$ hydrocarbyl, $R_2$ is $C_1$ to $C_{20}$ hydrocarbyl, and $R_3$ is $C_1$ to $C_{10}$ hydrocarbyl or hydrogen. A preferred amine of this type is ditallowmethylamine.

Preferably, the softening amine is present as a complex with a fatty acid of the formula RCOOH, wherein R is a $C_9$ to $C_{20}$ alkyl or alkenyl. It is desirable that the amine/fatty acid complex be present in the form of microfine particles, having a particle size in the range of from, e.g., 0.1 to 20 micrometers. These amine/fatty acid complexes are disclosed more fully in European Patent Application No. 0 133 804, the disclosures of which are incorporated herein by reference. Preferred are compositions that contain from 1% to 10% of the amine.

Suitable are also complexes of the above described amine and phosphate esters of the formula

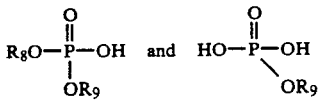

wherein $R_8$ and $R_9$ are $C_1$–$C_{20}$ alkyl, or ethoxylated alkyl groups of the general formula alkyl-$(OCH_2CH_2)_y$, wherein the alkyl substituent is $C_1$–$C_{20}$, preferably $C_8$–$C_{16}$, and y is an integer of 1 to 15, preferably 2–10, most preferably 2–5. Amine/phosphate ester complexes of this type are more fully disclosed in European Patent Application No. 0 168 889, the disclosures of which are incorporated herein by reference.

Further examples of optional softening ingredients include the softening amides of the formula $R_{10}R_{11}NCOR_{12}$, wherein $R_{10}$ and $R_{11}$ are independently selected from $C_1$–$C_{22}$ alkyl, alkenyl, hydroxy alkyl, aryl, and alkyl-aryl groups; $R_{12}$ is hydrogen, or a $C_1$–$C_{22}$ alkyl or alkenyl, an aryl or alkyl-aryl group. Preferred examples of these amides are ditallow acetamide and ditallow benzamide. Good results are obtained when the amides are present in the composition in the form of a composite with a fatty acid or with a phosphate ester, as described hereinbefore for the softening amines.

The amides are present in the composition at 1%–10% by weight.

The amine and amide softening ingredients may be added to the crutcher mix and spray-dried, or may be added as a dry powder to a detergent granule, or may be sprayed onto the detergent granule or onto a carrier, either in melted or in dissolved form. An example of a suitable carrier is perborate monohydrate.

Suitable softening ingredients are also the amines disclosed in U.K. Patent Application GB No. 2 173 827, the disclosures of which are incorporated herein by reference, in particular the substituted cyclic amines disclosed therein. Suitable are imidazolines of the general formula 1-(higher alkyl) amido (lower alkyl)-2-(higher alkyl)imidazoline wherein higher alkyl is alkyl having from 12 to 22 carbon atoms, and lower alkyl is alkyl having from 1 to 4 carbon atoms. Softener materials of this type are preferably added to the composition as particles or agglomerates as disclosed in U.S. patent application Ser. No. 922,912, filed Oct. 24, 1986 by Baker et al, the disclosures of which are incorporated herein by reference.

A preferred cyclic amine is 1-tallowamidoethyl-2-tallow imidazoline. Preferred compositions contain from 1% to 10% of the substituted cyclic amine.

Moreover, the compositions herein can contain, in addition to ingredients already mentioned, various other optional ingredients typically used in commercial products to provide aesthetic or additonal product performance benefits. Typical ingredients include pH regulants, perfumes, dyes, bleach, optical brighteners, soil suspending agents, hydrotropes and gel-control agents, freeze-thaw stabilizers, bactericides, preservatives, suds control agents, bleach activators and the like.

In a through-the-wash mode, the compositions are typically used at a concentration of at least 500 ppm, preferably 0.10% to 1.5, in an aqueous laundry bath at pH 7–11 to launder fabrics. The laundering can be carried out over the range from 5° C. to the boil, with excellent results.

INDUSTRIAL APPLICATION

The detergent compositions of the present invention are formulated into granular detergent compositions. For incorporation of the clay in a granular detergent several techniques are available.

For example, the clay may be added, as a powder or as a slurry, to a crutcher mix of conventional detergent ingredients, mixed, and spray dried to form a detergent granule.

Or the clay powder can be agglomerated to a desirable agglomerate size, and then be mixed with granules containing the other detergent ingredients. Clay granules for dry mixing can also be obtained by selecting a proper sieve fraction of natural agglomerates, by spraying a clay slurry onto a suitable particulate carrier, by agglomerating clay particles with sodium carbonate, by spray drying a clay slurry, etc.

The clay particles may also be incorporated in a substrate, like a pouch or a sheet, optionally with other softening ingredients. Substrates of this kind can be added to the laundry together with a conventional laundry detergent.

A preferred substrate is a pouch comprising the clay particles and particles of an alkyl amido alkyl-2-alkylimidazoline of the type described hereinabove.

EXAMPLES I-V

The following granular detergent compositions are prepared:

| INGREDIENT | COMPOSITION (% by weight) I | II | III | IV | V |
|---|---|---|---|---|---|
| $C_{11-12}$ alkyl benzene sulfonate (Na) | 7.0 | 5.0 | 4.0 | 1.0 | 6.5 |
| Tallow alcohol sulfate (Na) | — | 2.0 | — | — | 1.0 |
| A-Olefin ($C_{12-18}$) sulfonate (Na) | — | — | 2.0 | — | — |
| Tallow alcohol ethoxylate ($EO_{11}$) | 1.0 | 2.0 | 2.0 | — | 0.8 |
| Fatty alcohol ($C_{12-15}$) ethoxylate ($EO_7$) | — | — | — | 6.0 | — |
| Hydrogenated Tallow fatty acid | 2.5 | 1.0 | — | 1.0 | 1.0 |
| Coconut fatty acid | — | — | 1.5 | — | — |
| Dodecyl trimethyl ammonium chloride | — | 1.0 | — | — | 1.0 |
| Distearyl methyl amine | 3.0 | — | — | — | 3.0 |
| Ditallowbenzamide | — | 4.0 | — | — | — |
| Dodecyl dimethyl ammonium N-Oxide | 0.5 | — | 0.5 | — | 0.4 |
| Lauryl-N,N-dimethyl amine | — | — | 2.5 | — | — |
| Sodium tripolyphosphate | 24.0 | 18 | 22 | 32.0 | — |
| Zeolite 4A | — | — | — | — | 20.0 |
| Sodium nitrilotriacetate | — | — | — | — | 5.0 |
| Sodium sulfate | 12.4 | 17.7 | 15.0 | 21.3 | 12.7 |
| Sodium carbonate | — | 8.0 | — | 5.0 | — |
| Sodium silicate | 6.0 | 7.0 | 4.0 | 6.0 | 2.0 |
| Sodium perborate (4 aq.) | 20.0 | 15.0 | 18.0 | 10.0 | 18.0 |
| Carboxymethylcellulose | 0.3 | 0.3 | 0.5 | 0.8 | 0.4 |
| Polyacrylate (mw 1000-20000) | — | 1.5 | — | — | — |
| Polyacrylate (mw 4000-5000) | — | — | — | — | 3.0 |
| Copolymer maleic acid/acrylic acid (70/30) (mw 40.000-80.000) | 2.0 | — | 1.5 | 2.5 | — |
| Enzymes (protease, amylase, cellulase) | 0.6 | 0.2 | 0.5 | 0.5 | 0.3 |
| Optical brightener | 0.2 | 0.2 | 0.3 | 0.3 | 0.25 |
| Sulphonated zinc phthalocyamine | 30 ppm | — | — | 25 ppm | 25 ppm |
| EDTA | 0.2 | 0.2 | 0.3 | 0.15 | 0.2 |
| Ethylenediamine tetramethylene phosphonic acid | 0.2 | 0.1 | — | 0.1 | 0.1 |
| Tetraacetyl ethylenediamine | 1.5 | — | — | — | 1.5 |
| Iso-nonanoyloxy-benzene sulfonate (Na) | — | 2.0 | — | — | — |
| Silicone/silica suds suppressor | 0.2 | 0.15 | 0.15 | 0.25 | 0.2 |
| Perfume | 0.25 | 0.25 | 0.30 | 0.2 | 0.25 |
| Hectorite Clay* | 10.0 | 7.0 | 15.0 | 5.0 | 10.0 |
| Moisture and minors | balance to 100 | | | | |

*Bentone EW, a highly purified hectorite from Hector, CA, available from NL Chemicals, NJ. The clay particles have a lath shape, and a length:width ratio of 10:1, or higher (TEM data).

Layer Charge Distribution: more than 65% in the range of from 0.23 to 0.31.

The commercially available material has been treated with a wetting agent. The same material without the wetting agent is equally suitable. Suitable is also Macaloid (NL Chemicals, NJ), also a hectorite from Hector, Calf.

To a detergent composition of example I but without clay and distearyl methyl amine, various smectite clays were added at a level of 10%. A reference did not contain any smectite clay, but 10% Na-sulfate instead.

Each of the compositions was used in a laundry test as follows: 3 kg wash load and desired test swatches (cotton terry towels)* were laundered in a commercial automatic drum washing machine (MIELE W 726) using one wash cycle at 60° C. The detergent compositions were used at 1,12% concentration in 0,308 g CaCO3/l water hardness. The wash loads were line-dried at 20° C./65% relative humidity. The test swatches then were instrumentally assessed for softness, using the Kawabata KES-F system (shear hysteresis at 5 degrees 2HG5 as best correlating parameter with softness on KES-F-1 instrument). The sample size was 20×20 cm, whereby the area of sample which is actually subjected to shear stress is 20×5 cm. From the curves of shear stress against shear angle the shear hysteresis was calculated at 5° (2HG5) in N/m. Each measurement was repeated 8 times to calculate the confidence interval of the mean at 95% confidence level.

* Supplier: Santens—Belgium (type Lopez, 340 g/m$^2$).

Hectorite clays of the present invention gave a shear hysteresis reduction of 40%, on average.

Fabrics are laundered with the above detergent compositions, in usual fashion. The laundered fabrics are evaluated for handle and softness in Kawabata Evaluation System-Fabric (KES-F; a series of test instruments for measuring parameters that determine "softeness" and "handle" of fabrics. For the purposes of the present invention, shear hysteresis (2HG5) is of particular importance. The test method is described more fully in Melliard Testilbericht 67 (1986) pp 509-516.

EXAMPLES VI-X

The following granular detergent compositions are prepared:

| INGREDIENT | COMPOSITION (% by weight) VI | VII | VIII | IX | X |
|---|---|---|---|---|---|
| $NaC_{12}$ linear alkyl benzene sulfonate | — | — | — | — | 17.6 |

-continued

| INGREDIENT | COMPOSITION (% by weight) VI | VII | VIII | IX | X |
|---|---|---|---|---|---|
| $NaC_{13}$ linear alkyl benzene sulfonate | 14.3 | 7.1 | 6.8 | 20.1 | — |
| $NaC_{14-15}$ alcohol sulfate | 3.1 | 7.1 | 6.8 | 20.1 | — |
| $NaC_{12}$ alkyl polyethoxylate 6.5 T | 1.0 | 1.1 | 1.1 | — | — |
| STPP | — | 28.9 | 27.7 | 36.9 | 40.0 |
| Zeolite 4A | 16.5 | — | — | — | — |
| Silicate | 6.8 | 11.0 | 10.5 | 5.7 | 15.2 |
| Carbonate | 7.0 | — | 16.0 | 14.5 | — |
| Diethylenetriamine pentaacetic acid | — | 1.2 | 1.1 | — | 1.6 |
| Na perborate monohydrate | — | 4.9 | 5.0 | — | — |
| Sodium nonanoyl benzene sulfonate | — | 6.8 | 6.8 | — | — |
| Enzyme (protease) | 0.3 | | | — | — |
| Hectorite clay* | 7.5 | 6.8 | 4.7 | 8.9 | 9.5 |
| 1-tallowamidoethyl-2-tallow-imidazoline | — | — | — | 5.7 | — |
| Water, sulfate & Miscellaneous | balance to 100 | | | | |

*As in Examples I-V

EXAMPLE XI-XIV

Relative Deposition Measurement

A. Washing procedure:

Prewash: Cotton Polyester (86%/14%) terry cloths (Style 4025, Dundee Mills, Griffin, Ga.) that are 11×11 square inches (27.9×27.9 square cm) and weigh about 50 g each are used for the Relative Deposition test. The cloths are washed two times with a conventional non-clay containing detergent formulation (shown below) in 0 grain/gallon water at 125° F. (52° C.) for 12 minutes each, then washed two times in 0 grain/gallon water at 125° F. (52° C.) without detergent and dried in a Whirlpool 3 Cycle Portable Dryer (Model #LE4905XM, Whirlpool Corp., Benton Harbor, Mich.)

| Prewash Detergent Composition: Ingredient | % (Wt.) |
|---|---|
| $C_{12}$ Linear Alkyl Benzene Sulfonate (Na Salt) | 4.1 |
| Tallow Alcohol Sulfate (Na Salt) | 5.0 |
| Neodol ® 23-6.5 (Alkyl Ethoxylate) | 2.0 |
| Tallow Soap | 1.9 |
| Sodium Tripolyphosphate | 32.0 |
| Silicate | 6.5 |
| Water and Miscellaneous | balance to 100 |

Test Wash: A miniwasher with five pots (such as those manufactured by Yorktown Tool & Die Corp., Yorktown, Ind.) is used. 9.12 g of detergent product (Testwash Detergent Composition, as shown below) and 0.58 g of a clay of the present invention (77 ppm in the wash) are added to two gallons of 6 grain/gallon water at 95° F. (35° C.) in each mini-washer pot and agitated for two minutes. A load of fabrics weighing about 341 g and including test fabrics of four of the prewashed terry cloths, six polyester/cotton (65%/35%) 11×1 square inch (27.9×27.9 square cm) swatches (product #7435, Test Fabrics, Middlesex, N.J.) weighing a total of about 37 g, three 11×11 inch nylon swatches (product #322, Test Fabrics) weighing a total of about 18 g, three 11×11 inch polyester swatches (product #720-H, Test Fabrics) weighing a total of about 44 g, and one polyacrylic sock (Burlington Socks, Balfour Inc., Asheboro, N.C.) weighing about 42 g are added to the wash water. The fabrics are washed for 12 min., spin dried for two minutes, rinsed with two gallons of 6 grain/gallon water at 70° F. (21° C.) for two minutes, spin dried for two minutes, and dried in a Whirlpool 3 Cycle Portable (Model No. LE4905XM, Whirlpool Corp., Benton Harbor, Mich.). This test wash procedure is repeated for a second cycle, and the Relative Deposition is measured as described below.

| Test Wash Detergent Composition Ingredient | % (Wt.) |
|---|---|
| $C_{13}$ Linear Alkyl Benzene Sulfonate | 9.0 |
| $C_{14-15}$ Alkyl Sulfate | 9.0 |
| Neodol ® 23-6.5T (Alkyl ethoxylate) (Mgf. by Shell Chem. Co.) | 1.5 |
| Sodium Tripolyphosphate | 38.4 |
| Silicate | 14.6 |
| Sodium Carbonate | 21.3 |
| Water and Miscellaneous | balance to 100 |

B. Relative Deposition Measurement

The deposition of the clay containing compositions is calculated based on the deposition of silicon (Si) of terry cloth swatches washed with the test wash detergent composition relative to terry cloth swatches that were prewashed but not subjected to the test wash procedure (blank swatches). Silicon deposition is determined by measurement of the X-ray fluorescence of the silicon. Each Silicon fluorescence is measured in the following manner:

An EDAX 9500 X-ray fluorescence unit with a rhodium anode X-ray source (Philips Electronics, Inc., Cincinnati, Ohio) is used. Each terry cloth swatch is analyzed for 100 live seconds. Count rate of Si (on a per second basis) for each sample is measured and recorded.

Relative Deposition of clay is calculated by the following equation:

$$\text{Relative Deposition} = \frac{STF - SBF}{SW} \times 1000$$

wherein, STF is the Si count rate of clay-treated terry cloth fabric, SFB is the Si count rate of blank terry cloth fabric and SW is the Si count rate of a clay sample wafer (pressed clay particles of same area of terry cloth fabric). Count rates of Si for the clay sample wafer and clay deposition on fabric are measured as follows:

(a) Si count rate for clay sample wafer: The X-ray generator is set at 20 kV/500 microamps. About 2 g of clay powder is pressed at about 20,000 psi into a pellet with a 30 ton hydraulic press (Angstrom, Inc., Chicago, Ill.). The sample is rotated during the count rate analysis in a vacuum atmosphere (less than 300 millitorr).

(b) Si count rate for the terry cloth treated with clay: The X-ray generator parameter is set at 15 kV/500 microamps. A disk with a 3 cm diameter is cut from a terry cloth swatch. The disk is compressed at about 20,000 psi to form a flat smooth disk using a 30 ton hydraulic press, then rotated during the count rate analysis in a vacuum atmosphere.

(c) Typical Relative Depositions of clays of the Present Invention added during the wash stage as described in the preceding procedure are shown below:

| Natural Hectorite Clay | Relative Deposition |
|---|---|
| Example XI Bentone EW (available from NL Industries) | 3.1 |
| Example XII Macaloid (available from NL Industries) | 3.1 |
| Example XIII Turkish Ca Hectorite (mined in Turkey) | 3.9 |
| Example XIV IMV Hectorite (mined by Industrial Mineral Ventures, Amargosa Valley, Nevada) | 2.9 |

What is claimed is:

1. A granular detergent composition comprising: at least about 1% of a detersive surfactant; from about 5% to about 35% detergent builders; from about 1% to about 25% of a hectorite clay as a fabric softening ingredient, wherein said hectorite clay consists essentially of clay of natural origin having the general formula:

$$[(Mg_{3x}Li_x)\ Si_{4-y}Me^{III}_y\ O_{10}(OH_{2-z}F_z)]^{-(x+y)}\ \frac{(x+y)\ M^{n+}}{n}$$

wherein $Me^{III}$ is Al, Fe, or B; or y=0; $M^{n+}$ is a monovalent (n=1) or divalent (n=2) metal ion, said clay having a layer charge distribution (x+y) such that at least 50% of the layer charge is in the range of from about 0.23 to about 0.31; and in addition to said hectorite clay, from about 1% to about 10% of an additional fabric softening ingredient comprising: an amine of the formula $R_1\ R_2\ R_3\ N$, wherein $R_1$ is selected from $C_6$ to $C_{20}$ hydrocarbyl groups, $R_2$ is selected from $C_1$ to $C_{20}$ hydrocarbyl groups and $R_3$ is selected from $C_1$ to $C_{20}$ hydrocarbyl or hydrogen groups; or an amide of the formula $R_{10}R_{11}NCOR_{12}$, wherein $R_{10}$ and $R_{11}$ are independently selected from $C_1$–$C_{22}$ alkyl, alkenyl, hydroxy alkyl, aryl, and alkyl-aryl groups, $R_{12}$ is hydrogen, a $C_1$–$C_{22}$ alkyl or alkenyl, an aryl group, an alkyl-aryl group, or an O-$R_{13}$ group, wherein $R_{13}$ is selected from a $C_1$–$C_{22}$ alkyl or alkenyl group, an aryl, or an alkyl-aryl group; or a 1-(higher alkyl) amide (lower alkyl)-2-(higher alkyl) imidazoline, wherein said higher alkyl is an alkyl having from about 12 to about 22 carbon atoms, and said lower alkyl is an alkyl having from about 1 to about 4 carbon atoms.

2. A granular detergent composition according to claim 1, wherein said hectorite clay has a distribution of layer charge (x+y) such that at least about 65% of the layer charge is in the range of from about 0.23 to about 0.31.

3. A granular detergent composition according to claim 2, comprising from about 1% to about 25% of a hectorite clay of natural origin, wherein cotton terry towels laundered with a detergent composition containing about 10% (weight) of the hectorite clay show a reduction of the shear hysteresis, 2HG5, of at least about 32%.

4. A granular detergent composition according to claim 3, wherein the reduction of the shear hysteresis is at least about 35%.

5. A method for washing and softening fabrics with a detergent composition containing a fabric softening clay, wherein said detergent comprises at least about 1% of a detersive surfactant, from about 5% to about 35% detergent builders, and from about 1% to about 25% of a hectorite clay of natural origin, said hectorite clay having the general formula:

$$[(Mg_{3x}Li_x)\ Si_{4-y}Me^{III}_y\ O_{10}(OH_{2-z}F_z)]^{-(x+y)}\ \frac{(x+y)\ M^{n+}}{n}$$

wherein $Me^{III}$ is Al, Fe, or B; or y=0; $M^{n+}$ is a monovalent (n=1) or divalent (n=2) metal ion, said clay having a layer charge distribution (x+y) such that at least 50% of the layer charge is in the range of from about 0.23 to about 0.31, and wherein said detergent composition is used at a concentration of at least about 500 ppm in an aqueous laundry bath.

6. A granular detergent composition according to claim 1 wherein $R_1$ and $R_2$ of said amine are each alkyl having from about 12 to about 18 carbon atoms, and $R_3$ is methyl.

7. A granular detergent composition according to claim 6 wherein the amine is present in the form of a complex with a fatty acid of the formula RCOOH, wherein R is a $C_9$ to $C_{20}$ alkyl or alkenyl.

8. A granular detergent composition according to claim 7 wherein the amine is present in form of a complex with a phosphate ester of the formula:

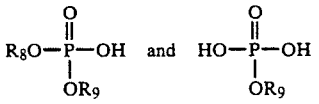

wherein $R_8$ and $R_9$ are $C_1$–$C_{20}$ alkyl, or ethoxylated alkyl groups of the general formula alkyl-$(OCH_2CH_2)_y$, wherein the alkyl substituent is $C_1$–$C_{20}$, and y is an integer of 1 to 15.

9. A granular detergent composition according to claim 4 wherein the amide is present in the form of a composite with the fatty acid of the formula RCOOH, wherein R is a $C_9$ to $C_{20}$ alkyl or alkenyl.

10. A granular detergent composition according to claim 4 further comprising from about 5% to about 35% of a builder system, said builder system comprising:

(a) from about 1% to about 99% by weight of a tartrate monosuccinate component of the structure:

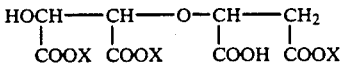

wherein X is H or a salt-forming cation; and (b) from about 1% to about 99% by weight of a tartrate disuccinate component of the structure:

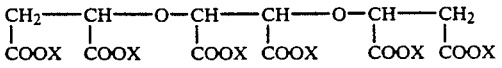

wherein X is H or a salt-forming cation.

11. A granular detergent composition according to claim 4 comprising from about 1% to about 25% of a hectorite clay of natural origin, wherein the relative deposition of the clay is at least about 2.5.

12. A granular detergent composition according to claim 11, wherein the Relative Deposition of the clay is at least about 2.7.

13. A granular detergent composition according to claim 12, wherein the Relative Deposition of the clay is at least about 2.9.

* * * * *